US005758915A

United States Patent [19]

Quinn et al.

[11] Patent Number: 5,758,915

[45] Date of Patent: Jun. 2, 1998

[54] GOLF BALL RETRIEVAL RAKE

[75] Inventors: Edwin A. Quinn; Mary L. Quinn, both of Naples, Fla.

[73] Assignee: Deborah A. Quinn, Naples, Fla.

[21] Appl. No.: 775,124

[22] Filed: Dec. 30, 1996

Related U.S. Application Data

[62] Division of Ser. No. 397,484, Mar. 2, 1995, Pat. No. 5,590,924.

[51] Int. Cl.[6] ..... A01D 7/06; A63B 47/02

[52] U.S. Cl. ..... 294/19.2; 56/400.19

[58] Field of Search ..... 294/19.2, 52, 53.5, 294/55, 55.5, 66.1; 37/316; 56/8, 400.04, 400.11–400.13, 400.16, 400.18–400.21; 172/378; 473/286

[56] References Cited

U.S. PATENT DOCUMENTS

| | | | |
|---|---|---|---|
| D. 206,076 | 10/1966 | Lehman | 294/19.2 X |
| 1,141,423 | 6/1915 | Simas | 294/19.2 X |
| 1,272,567 | 7/1918 | Swan | 56/400.19 X |
| 1,356,972 | 10/1920 | Crisman | 56/400.19 |
| 2,738,214 | 3/1956 | Zimmers | 294/19.2 |
| 2,902,815 | 9/1959 | Gallo | 56/400.19 |
| 4,254,981 | 3/1981 | Wilson | 294/19.2 |
| 5,311,733 | 5/1994 | Krenkel | 294/19.2 X |
| 5,482,338 | 1/1996 | Hall | 294/19.2 |
| 5,511,841 | 4/1996 | Allen | 294/19.2 X |

*Primary Examiner*—Johnny D. Cherry
*Attorney, Agent, or Firm*—Don Halgren

[57] ABSTRACT

The present invention comprises a golf ball rake having a pair of frame members extending from an elongated handle. A plurality of curved tines extend from each frame member. Each tine has an elongated linear distal portion and a curved proximal portion. The linear distal portions are arranged to rake between long thick weeds and vegetation and the tines have a curved proximal portion to define a holding area for retrieval of golf balls.

4 Claims, 3 Drawing Sheets

GOLF BALL RETRIEVAL RAKE

This is a Divisional Application of U.S. patent application Ser. No. 08/397,484, filed 03/02/95, now U.S. Pat. No. 5,590,924.

BACKGROUND OF THE INVENTION (1) Field of the Invention

This invention relates to golf ball retrieval devices and, more particularly, to rakes which are adapted to retrieve golf balls from water hazards.

(2) Prior Art

Golfing is a sport which sends its balls into long hits and often into undesirable locations. Golf balls are often hit into "the rough" or tall vegetation or small ponds, water hazards, or the like.

Retrieving rakes are known in the golfing field and are relatively common. The known rakes however, do not always work well in water hazards, which include grass or other vegetation in the water.

Examples of typical retrieval rakes are shown in U.S. Pat. No. 4,254,981 to Wilson, which has a plurality of U-shaped fingers and a sliding bar for the spaced apart control thereof. U.S. Pat. No. 4,635,987 to Hurtgam has a rigid C-shaped head and lower stabilizing bar which holds its legs in a fixed position.

U.S. Pat. 4,974,894 to Dubow shows a rake having outer prongs with closed loops and inner prongs having distal ends which bend sharply upwardly toward the handle of the rake.

U.S. Pat. No. 5,110,168 to Petrillo discloses a rectangular, rigid housing on a handle which acts to hold a collection of balls therein.

U.S. Pat. No. 5,246,260 to Racicot shows a plurality of spaced rigid U-shaped fingers at the end of a handle, each of the fingers having a triangularly-shaped, closed loop at the distal end thereof.

U.S. Pat. No. 3,437,368 to Anderson shows a handle with a transversely extending coil spring on its distal end, the spring coil being pivotable so as to fold on its handle.

Design Pat. No. 206,076 shows a rake with a plurality of curved fingers fixed at their proximal ends to a handle and at their distal ends by a connector bar.

The rakes of the prior art do not appreciate the problems encounterable in water hazards having vegetation of heavy grass therein.

It is therefore an object of the present invention, to provide a golf ball retrieval device which can overcome the disadvantages of the prior art.

It is a further object of the present invention to provide a golf ball retrieval rake which works well in vegetation to ensnare lost golf balls in a manner superior to that of the prior art.

BRIEF SUMMARY OF THE INVENTION

The present invention comprises a golf ball retrieval rake. The retrieval rake has an elongated handle which may have a plurality of telescoping sections.

The distalmost end of the handle has a rigid transversely disposed frame member thereon. The frame member extends out equally, on each side of the handle. A plurality of curved tines are fixedly attached to the frame member, in a spaced-apart relationship, the space between the tines being less than the diameter of a golf ball.

Each tine has a proximal end which extends into the frame member, for securement thereto. Each tine then bends into a first curved portion which comprises at least a first semi-circular section of a diameter slightly greater than a golf ball. Each tine then extends at a slight angle from the semi-circular portion to a generally straight distal portion. The generally straight distal portion of each tine extends a length of about at least 3 inches. Each straight distal portion has a longitudinal axis which lies in a plane that is disposed at an angle "A", of about 20 degrees to about 45 degrees with respect to the longitudinal axis of the handle.

The distal-most end of each tine may be rounded and somewhat flat in a "paddle shape" configuration. A reinforcing rod extends across adjacent tines, parallel to the frame member, near the proximal end of the semi-circular section.

Each tine at the opposite ends of the frame member has a second semi-circular section opposedly attached thereat. The second semi-circular section and its first semi-circular section comprise sides of the rake, having a minor diameter which is smaller than the diameter of a golf ball. The first and second semi-circular sections may comprise oval or elongated circles.

In a further embodiment, the frame member may be arranged in a "V" shape, that is, disposed at an angle of about 15 degrees to 35 degrees with respect to the longitudinal axis of the handle.

In yet a further embodiment, the frame member may be split, so as to include a pivot point such as an adjustable bolt about which each side of the frame member may pivot, to permit adjustment of raking width (and angle) and to permit collapsibility of the retrieval rake in storage (such as in a golf bag).

Each of the tines in this further embodiment on one side of the frame member is spaced further from the pivot than the tines on the other side of the frame member, to permit them to fold adjacent to one another when collapsed, to minimize storage requirements.

The present invention permits improved ball retrieval because of the angularity of the unrestricted distal ends of the tines, permitting them to "comb" through the grass, scooping up the golf balls into the "semi-circumferential" holding area.

The present invention thus comprises a golf ball retrieving rake for retrieving golf balls from area of vegetation, comprising: an elongated handle having a proximal and a distal end; a frame member attached to the distal end of the handle; a plurality of tines attached to the frame member; each of the tines having a first portion of generally semi-circular configuration, and a proximal end thereof attached to the frame member; each of the tines having an elongated distal portion; and each of the distal portions being of extended linear configuration, to rake between vegetation. The rake handle has a longitudinal axis, and the elongated distal portions of the tines each have a longitudinal axis, with an angle of about 20 degrees to about 45 degrees between the longitudinal axis of the handle and the elongated axis of the distal portion of the tines. The frame member has a tine at each end thereof, each end tine having a further generally semi-circular portion to define a cage for any balls, retrieved therewithin.

Each of the elongated linear distal portions of the tines is at least about 5 centimeters long. The frame member is comprised of a side portion on each side of the handle, each of the side portions having a longitudinal axis which is disposed at an angle of about 75 to 85 degrees with respect to the longitudinal axis of the handle. The frame member is comprised of a pair of side portions, one on each side of the handle; each of the side portions may be pivotally connected to the handle at a pivot axis to permit it to fold up for easy storage. The tines on one of the side portions is spaced closer to the pivot axis than the tines on the other of the side portions, to permit the side portions to interengage with one another without interference during fold-up thereof. The further generally semicircular portion defines a circle or oval with the first generally semicircular portion.

BRIEF DESCRIPTION OF THE DRAWINGS

The objects and advantages of the present invention will become more apparent when viewed in conjunction with the following drawings, in which.

DESCRIPTION OF PREFERRED EMBODIMENTS

Figure 1:
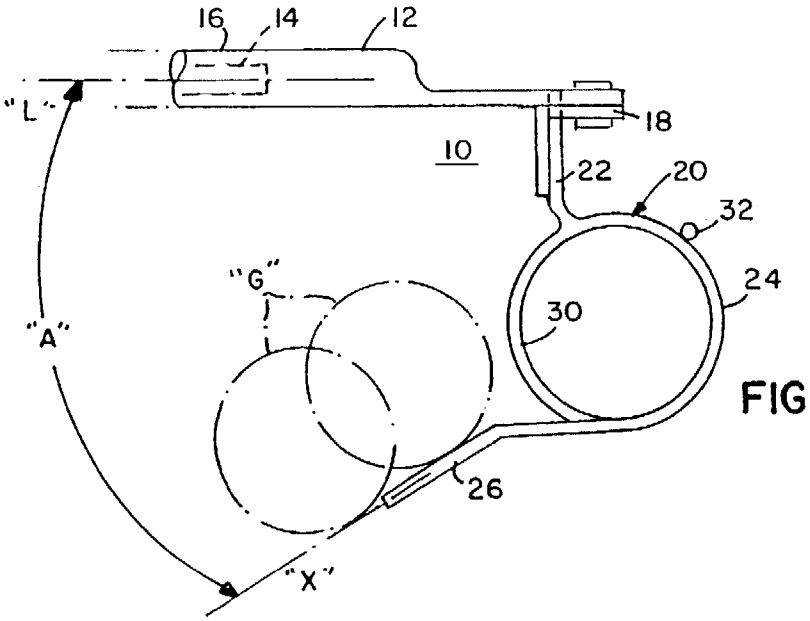
FIG. 1 is a side view of the distal end of a handle and frame portion of the present invention.
Figure 2:
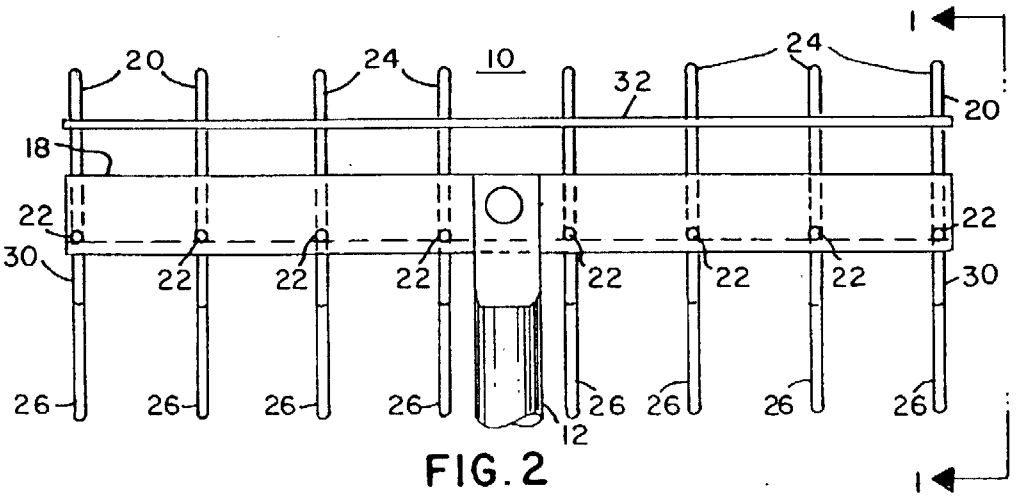
FIG. 2 is a plan view of the distal end of a handle and frame portion shown in FIG. 1.
Figure 3:
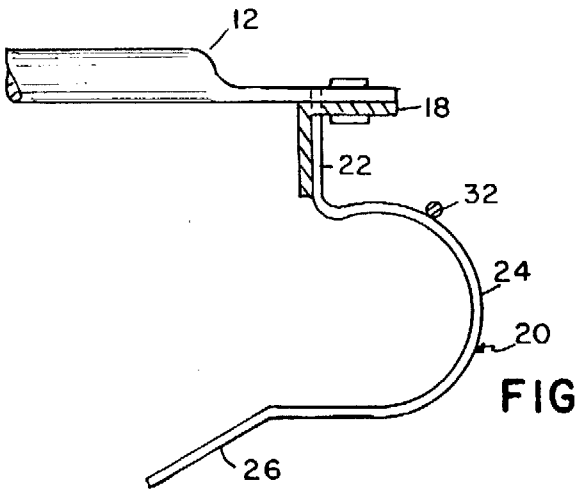
FIG. 3 is a view taken along the line III—III of FIG. 4.

The present invention in a first preferred embodiment, comprises a golf ball retrieval rake 10, as shown in FIGS. 1 and 2. The retrieval rake 10 has an elongated handle 12 which may have a plurality of telescoping sections 14 and 16. The distalmost end of the handle has a rigid transversely disposed frame member 18 arranged thereacross.

The frame member 18 extends, out equally, on each side of the handle 12. A plurality of curved tines 20 are fixedly attached to the frame member 18, in a spaced-apart relationship, the space between the tines 20 being less than the diameter of a golf ball "G", as shown in phantom in FIG. 1.

Each tine 20 has a proximal end 22 which extends into the frame member 18, for securement thereto. Each tine 20 then bends into a first curved portion 24 which comprises at least a first generally semi-circular section. Each tine 20 then bends outwardly slightly and then extends to a generally straight distal portion 26. The generally straight distal portion 26 extends a length of about at least 5 cms. Each straight distal portion 26 has a longitudinal axis "x" which lies in a plane that is disposed at an angle "A", of about 20 degrees to about 45 degrees with respect to the longitudinal axis "L" of the handle 12, as shown in FIG. 1. Each tine 20 at each end of the frame member 18 has a further arcuate segment 30, which completes a circle with the first curved portion 24.

The distalmost end of each tine 20 may be rounded and somewhat flat in a "paddle-shape" configuration.

A reinforcing rod 32 may extend across adjacent tines 20, parallel to the frame member 18, near the proximal end of each semi-circular section 24.

Each tine 20 at the opposite ends of the frame member 18 has a second generally semi-circular section 30 opposedly attached thereat, as aforementioned. The second semi-circular section 30 and its first semi-circular section 24 define sides of the rake 10, having a minor diameter which is smaller than the diameter of a golf ball to prevent it from escaping therethrough. The first and second semi-circular sections 24 and 30 preferably comprise slightly oval or elongated circles.

Figure 4:
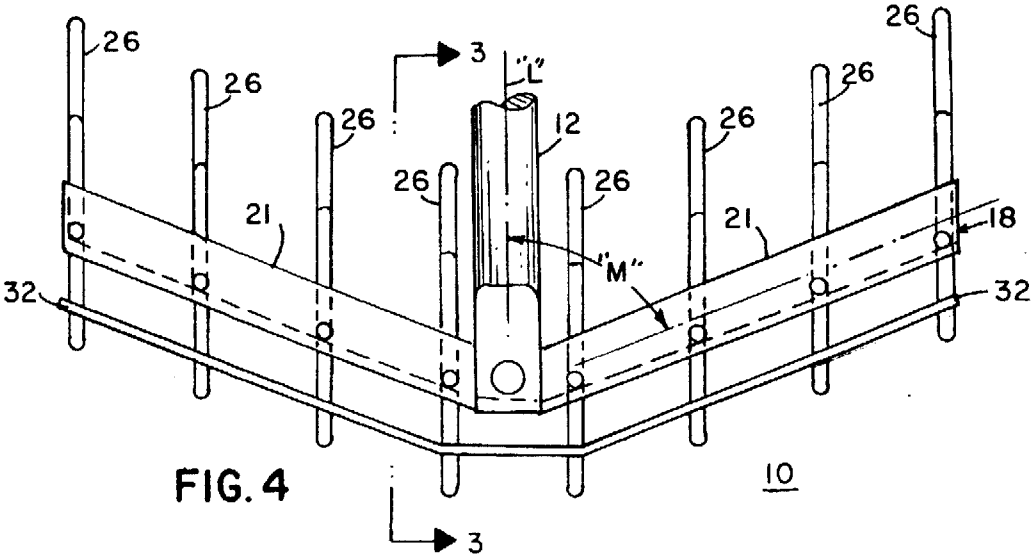
FIG. 4 is a plan view, similar to that of FIG. 2, showing a further embodiment of the present invention.

In a further preferred embodiment, as shown in FIG. 4, the frame member 18 has each of its side portions 21 arranged in a "V" shape, that is, disposed at an angle "M" of about 75 degrees to about 85 degrees with respect to the longitudinal axis "L" of the handle 12. The tines 20 are correspondingly disposed in that generally "V" shaped formation, to provide an improved raking function, and to be less likely to lose golf balls being raked in.

Figure 5:
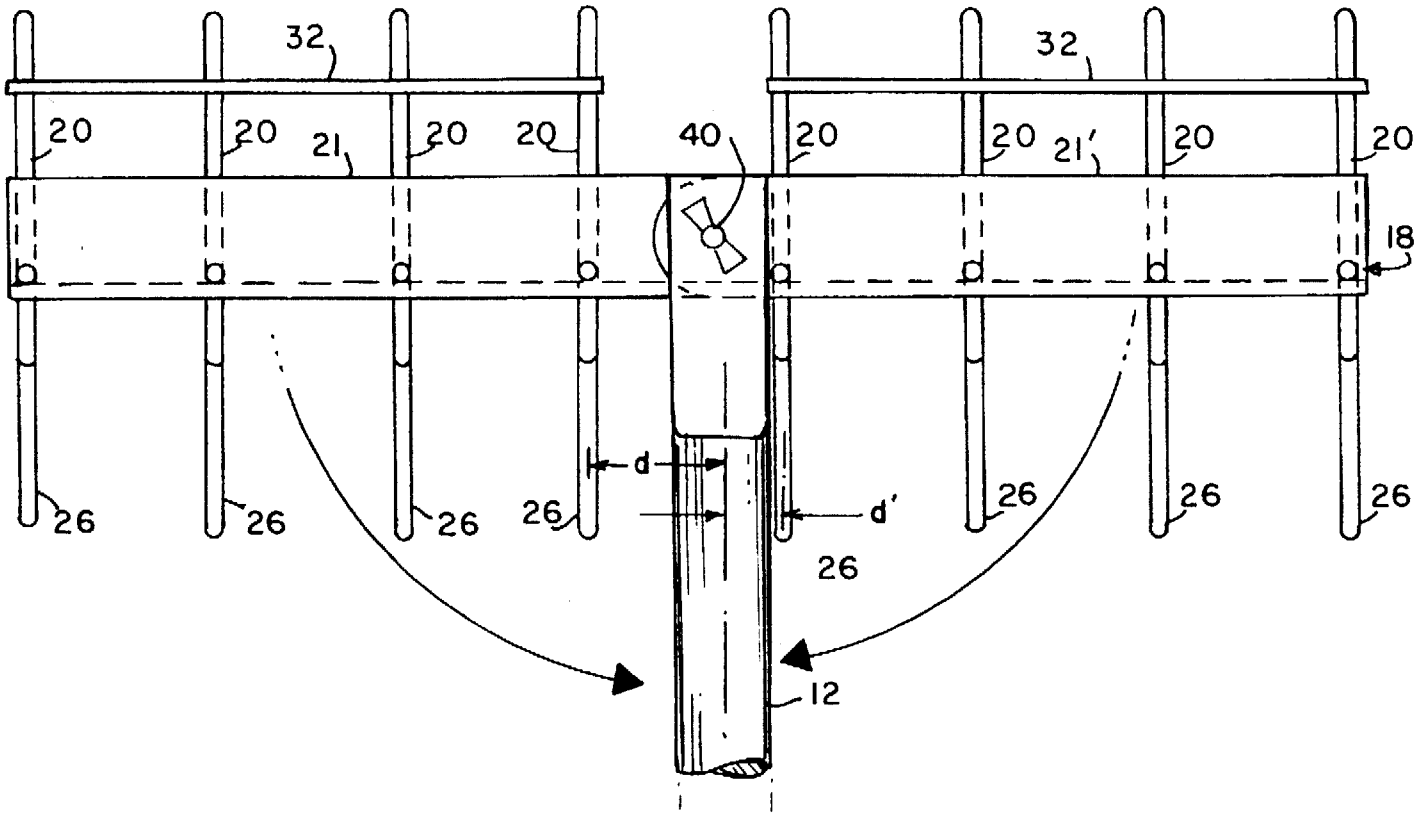
FIG. 5 is a partial plan view of a pivot arrangement of the frame assembly in a yet further embodiment thereof.

In yet a further preferred embodiment, as shown in FIG. 5, the frame member 18 may be split at its mid-point, having a pivot axis 40 such as an adjustable bolt about which each side 21 and 21' of the frame member 18 may pivot, to permit adjustment of raking width (and angle) and to permit collapsibility of the retrieval rake 10 in storage (such as in a golf bag).

Each of the tines 20 in this further embodiment, on one side portion 21 of the frame member 18, is spaced a further distance from the pivot axis 40, than are the tines 20 which are spaced a distance d∝ from the pivot axis 40, (which is on the center line of the handle 12), on the other side of the frame member 18, to permit the side portions 21 and 21' to fold up towards one another when collapsed, without interference, to minimize storage requirements.

In yet another preferred embodiment of the present invention, only one side member 21 is attached to the handle 12, or the frame member 21 is of very short length, sufficient to hold only one or two golf balls. This would make it unnecessary to have to fold the frame members together for storage in a golf bag. The length of the frame member would for this embodiment, be about 6 to about 8 cms long.

The present invention permits improved ball retrieval because of the angularity of the "unrestricted" tines 20, that is, attached and supported only at their juncture with their respective generally semi-circular sections, the elongated distal ends of the tines 20, thus being permitted to "comb" through the grass and vegetation, scooping up the golf balls into the holding area defined by the tines generally semi-circumferential curved portion 24.

Thus, what has been shown is a novel golf ball rake which permits adjustability of the rake width for enlarging the scope and swath of the rake, and to permit the rake to be adjustable where necessary, and to be folded-up for easy storage.

We claim:

1. A golf ball retrieving rake for retrieving golf balls from areas of heavy vegetation, comprising:

an elongated handle having a proximal and a distal end;

a frame member attached to the distal end of the handle;

a plurality of interdigitatable tines attached to said frame member;

each of said interdigitatable tines having a first portion of generally semi-circular configuration, and a proximal end thereof attached to said frame member;

each of said interdigitatable tines having an elongated distal portion;

each of said distal portions of said interdigitatable tines being of extended linear configuration, to permit them to extend well into long vegetation in retrieval of golf balls; and wherein said frame member is comprised of a pair of side portions, one on each side of said handle, each of said side portions being pivotally connected to said handle at a pivot axis to permit it to fold-up for easy storage; wherein said interdigitatable tines on one of said side portions are spaced closer to said pivot axis than the interdigitatable tines on the other of said side portions, so as to interdigitate with one another without interference during fold-up thereof.

2. A golf ball retrieval rake for retrieving golf balls in areas of long vegetation, comprising:

an elongated handle having a proximal end and a distal end;

a pair of frame members pivotally attached at a common axis to said distal end of said handle;

a plurality of interdigitatable vegetation raking tines disposed on each of said frame members and each of said interdigitatable tines on one of said frame members being spaced from the longitudinal axis of said handle a different distance than the corresponding ones of said interdigitatable tines on the other of said frame members, so that when said frame members are pivoted towards one another for storage, said interdigitatable tines on each of said frame members will not interfere with one another.

3. A golf ball retrieval rake as recited in claim 2, including a reinforcing rod attached to a curvilinear portion of each of said tines on each of said frame members without connecting said frame members on opposing sides of said handle.

4. A method of making a golf ball retrieval rake for collecting golf balls from between vegetation, comprising:

arranging an elongated handle for supporting a golf ball retrieval cage therein, said handle, having a proximal and a distal end;

securing a frame member from opposing sides of the distal end of said handle;

attaching a plurality of curvilinear interdigitatable tines to each of said frame members, each of said interdigitatable tines having a generally semicircular proximal portion and a linear distal portion; and installing each of said frame members onto an adjustable pivot axis which permits each of said frame members to be pivoted into generally parallel alignment with said elongated handle; and spacing said interdigitatable tines on one of said frame members a different distance from the longitudinal axis of said elongated handle than the interdigitatable tines on the other said frame member so as to be clear of interference therebetween when said frame members are folded towards one another and said tines are interdigitated.

* * * * *